US006283345B1

(12) United States Patent
Butschat

(10) Patent No.: US 6,283,345 B1
(45) Date of Patent: Sep. 4, 2001

(54) PAINT CONTAINER SYSTEM

(76) Inventor: Jonathan Butschat, 1447 LihoLiho 6D, Honolulu, HI (US) 96822

( * ) Notice: Subject to any disclaimer, the term of this patent is extended or adjusted under 35 U.S.C. 154(b) by 0 days.

(21) Appl. No.: 09/406,940

(22) Filed: Sep. 28, 1999

(51) Int. Cl.[7] ..... A45F 3/16

(52) U.S. Cl. ..... 224/148.4; 224/148.7; 224/195; 224/197; 224/663; 224/679; 224/271; 224/272; 224/904

(58) Field of Search ..... 224/148.1, 148.4, 224/148.7, 576, 581, 195, 197, 663, 665, 666, 677, 679, 680, 271, 272, 904

(56) References Cited

U.S. PATENT DOCUMENTS

D. 286,949 * 12/1986 Hardman ..... D2/400
3,283,971 * 11/1966 Jones ..... 224/148 X
4,325,503 * 4/1982 Swinney ..... 224/148
4,746,042 * 5/1988 King ..... 224/148
5,489,051 * 2/1996 Robinson ..... 224/148

* cited by examiner

*Primary Examiner*—Stephen K. Cronin
(74) *Attorney, Agent, or Firm*—Michael S. Neustel

(57) ABSTRACT

A paint container system for attachment to a person that maintains a substantially vertical position regardless of the position of the person. The inventive device includes a tubular belt adapter for removably attaching to a conventional hip belt, a shaft having a flanged end extending from the belt adapter, a container having a receiver aperture within an upper portion for removably receiving the shaft, and a bracket having a pair of resilient clips attached thereto for attaching within the container. The container preferably has four side walls, a floor and an upper open end. An extended portion from the container includes the receiver aperture for receiving the shaft of the belt adapter. The container swivels upon the shaft of the belt adapter during use thereby maintaining the container in a substantially vertical position at all times regardless of the position of the user. The bracket for supporting a paintbrush is positionable about the upper rim of the container in any desired located.

9 Claims, 5 Drawing Sheets

PAINT CONTAINER SYSTEM

BACKGROUND OF THE INVENTION

1. Field of the Invention

The present invention relates generally to paint devices and more specifically it relates to a paint container system for attachment to a person that maintains a substantially vertical position regardless of the position of the person.

Painters often times utilize conventional paint cans when painting. The painter will generally grasp the handle of the paint can with one hand while utilizing the other hand to retain the paintbrush. Carrying the paint can over extended periods of time can be very tiring for the painter. In addition, sometimes the painter must climb a ladder for painting higher areas. Climbing the ladder while retaining the paint can with one hand can be extremely dangerous for the painter. Hence, there is a need for a painting system that allows the painter's hands to remain free when climbing ladders.

2. Description of the Prior Art

Painting devices have been in use for years. Typically, a conventional paint can includes a cylindrical container having an inverted U-shaped handle pivotally attached thereto. The user typically grasps the handle with one hand while utilizing the other hand to manipulate the paintbrush.

Convention paint can devices are extremely tiring for painters to carry throughout the day. In addition, paint cans left upon the ground or other surfaces often times become accidentally tipped over. Also, when utilizing a conventional paint can, the user must utilize at least one hand to support the paint can while climbing a structure such as a ladder.

Examples of paint containers include U.S. Pat. No. 5,490,618 to Davidson; U.S. Pat. No. 5,016,791 to Burow; U.S. Pat. No. 4,527,720 to Hayes; U.S. Pat. No. 4,746,042 to King; U.S. Pat. No. 5,489,051 to Robinson which are all illustrative of such prior art.

Davidson (U.S. Pat. No. 5,490,618) discloses a paint pail carrier. Davidson teaches a paint pail for attachment to a person for maintaining an open paint pail in a vertical orientation. Davidson comprises a paint pail cradle having a vertically orientated elongated member having a lower section with a horizontally disposed base for supporting a conventional paint pail.

Burow (U.S. Pat. No. 5,016,791) discloses a painter's hip level pail carrier. Burow teaches a girdle secured to the hips of the painter and with a bearing carried by an apron depending from the girdle to swing the pail on a horizontal axis.

Hayes (U.S. Pat. No. 4,527,720) discloses a paint can holder. Hayes teaches a device that is suspended form the belt of the user thereof and supports a paint can by the handle.

While these devices may be suitable for the particular purpose to which they address, they are not as suitable for attaching to a person and maintaining a substantially vertical position regardless of the position of the person. Conventional paint cans require the user to utilize one hand to support the paint can during painting and climbing of ladders. Conventional paint devices are also awkward to utilize over extended periods of time.

In these respects, the paint container system according to the present invention substantially departs from the conventional concepts and designs of the prior art, and in so doing provides an apparatus primarily developed for the purpose of attachment to a person and maintaining a substantially vertical position regardless of the position of the person.

SUMMARY OF THE INVENTION

In view of the foregoing disadvantages inherent in the known types of painting devices now present in the prior art, the present invention provides a new paint container system construction wherein the same can be utilized for attachment to a person that maintains a substantially vertical position regardless of the position of the person.

The general purpose of the present invention, which will be described subsequently in greater detail, is to provide a new paint container system that has many of the advantages of the paint devices mentioned heretofore and many novel features that result in a new paint container system which is not anticipated, rendered obvious, suggested, or even implied by any of the prior art painting systems, either alone or in any combination thereof.

To attain this, the present invention generally comprises a tubular belt adapter for removably attaching to a conventional hip belt, a shaft having a flanged end extending from the belt adapter, a container having a receiver aperture within an upper portion for removably receiving the shaft, and a bracket having a pair of resilient clips attached thereto for attaching within the container. The container preferably has four side walls, a floor and an upper open end. An extended portion from the container includes the receiver aperture for receiving the shaft of the belt adapter. The container swivels upon the shaft of the belt adapter during use thereby maintaining the container in a substantially vertical position at all times regardless of the position of the user. The bracket for supporting a paintbrush is positionable about the upper rim of the container in any desired located.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a paint container system that will overcome the shortcomings of the prior art devices.

Another object is to provide a paint container system that is capable of remaining upon the person at all times during painting.

An additional object is to provide a paint container system that leaves the user's hands free to climb ladders and other structures.

A further object is to provide a paint container system that will maintain a substantially vertical position regardless of the position of the user.

Another object is to provide a paint container system that slides onto a conventional belt of the user.

A further object is to provide a paint container system that supports a paintbrush when not in use.

An additional object is to provide a paint container system that allows the painter to adjust depending upon whether they are left handed or right handed.

Another object is to provide a paint container system that is capable of receiving various sizes and shapes of paintbrushes.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
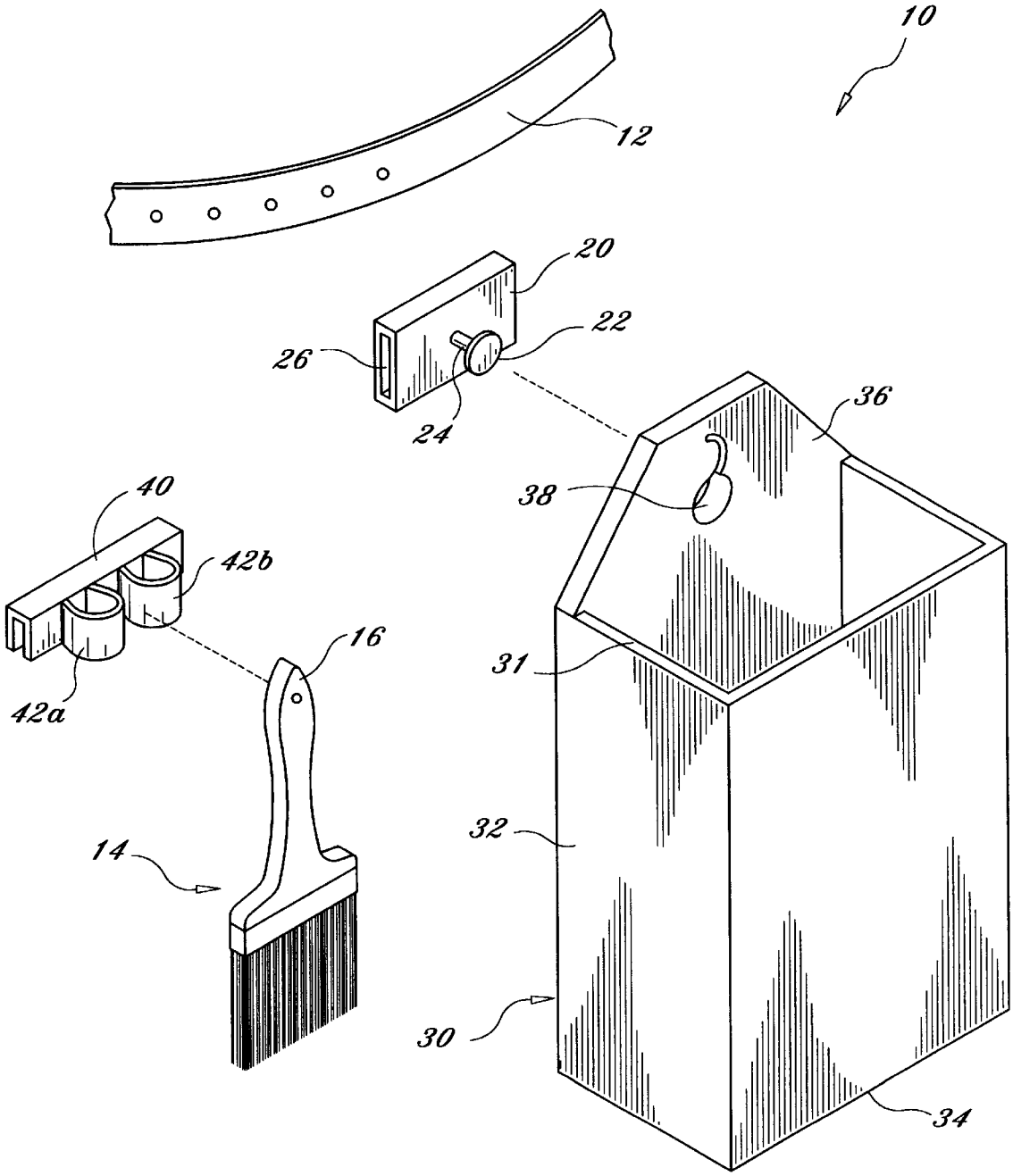
FIG. 1 is an exploded upper perspective view of the present invention.

Turning now descriptively to the drawings, in which similar reference characters denote similar elements throughout the several view, FIGS. 1 through 5 illustrate a paint container system 10, which comprises a tubular belt adapter 20 for removably attaching to a conventional hip belt 12, a shaft 24 having a flanged end 22 extending from the belt adapter 20, a container 30 having a receiver aperture 38 within an upper portion for removably receiving the shaft 24, and a bracket 40 having a pair of resilient clips 42*a–b* attached thereto for attaching within the container 30. The container 30 preferably has four side walls 32, a floor 34 and an upper open end 31. An extended portion 36 from the container 30 includes the receiver aperture 38 for receiving the shaft 24 of the belt adapter 20. The container 30 swivels upon the shaft 24 of the belt adapter 20 during use thereby maintaining the container 30 in a substantially vertical position at all times regardless of the position of the user. The bracket 40 for supporting a paintbrush 14 is positionable about the upper rim of the container 30 in any desired located.

Figure 4:
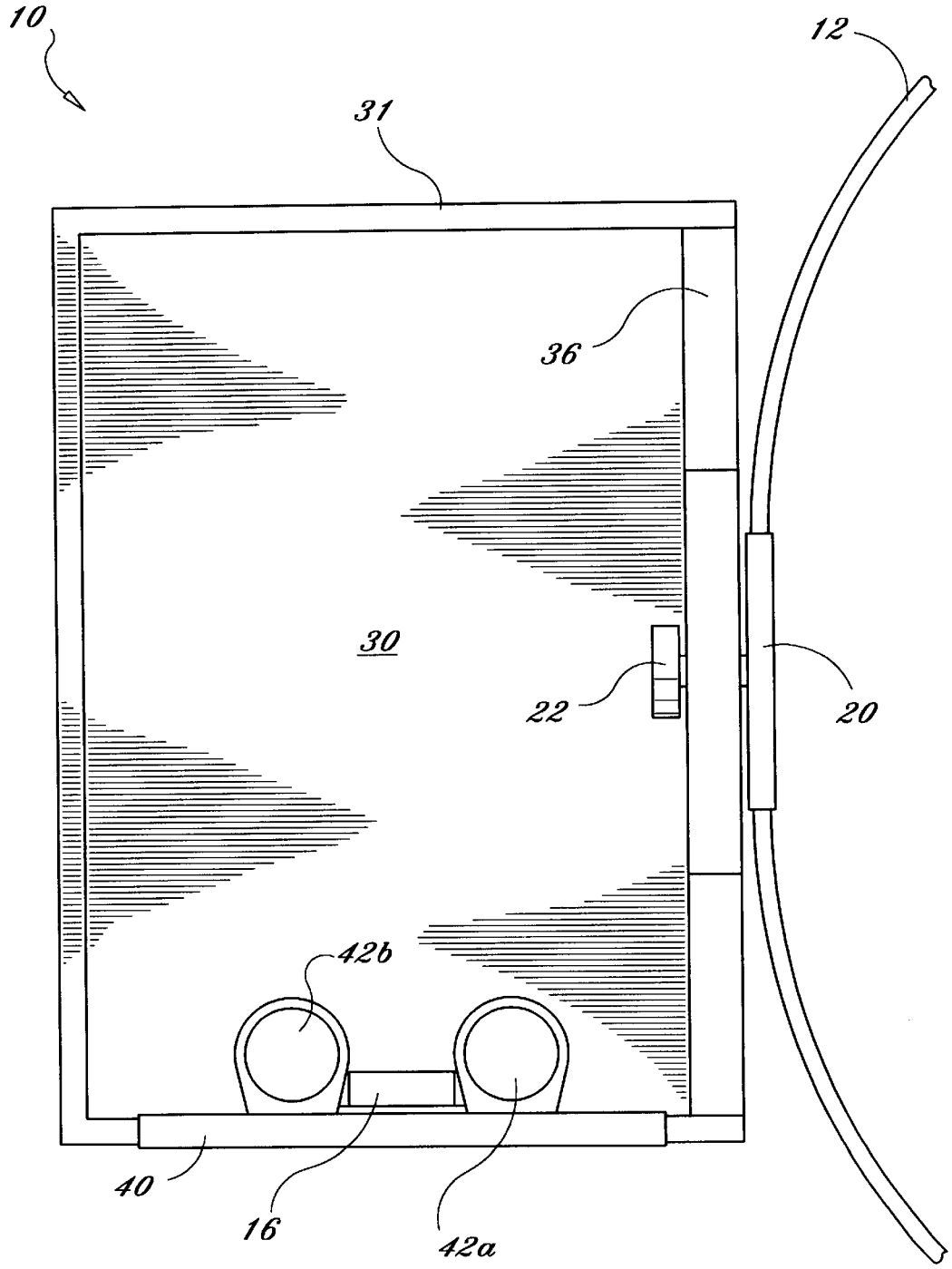
FIG. 4 is a top view of the present invention.

As best shown in FIG. 1 of the drawings, the belt adapter 20 is a tubular structure having a lumen 26 for receiving a hip belt 12 of the user. The belt adapter 20 preferably has a rectangular cross sectional area for receiving a conventional hip belt 12 as shown in FIG. 4 of the drawings. The belt adapter 20 may be constructed of any well-known material such as plastic or metal.

As best shown in FIGS. 1 and 4 of the drawings, a shaft 24 extends orthogonally from the belt adaptor. The shaft 24 has a flanged end 22 as shown in FIGS. 1, 2, 4 and 5 of the drawings for pivotally retaining the container 30. The shaft 24 may be attached to the belt adapter 20 through any conventional means or directly molded into the belt adapter 20.

As shown in FIGS. 1 through 4, the container 30 is an open structure capable of storing a volume of paint or other fluid. The container 30 may be constructed of any well-known material. The container 30 preferably has four side walls 32 forming a rectangular structure, however it can be appreciated that less than four side walls 32 may be utilized to construct the container 30. For example, a single side wall 32 could be utilized having a cylindrical shape or other well-known shape.

Figure 2:
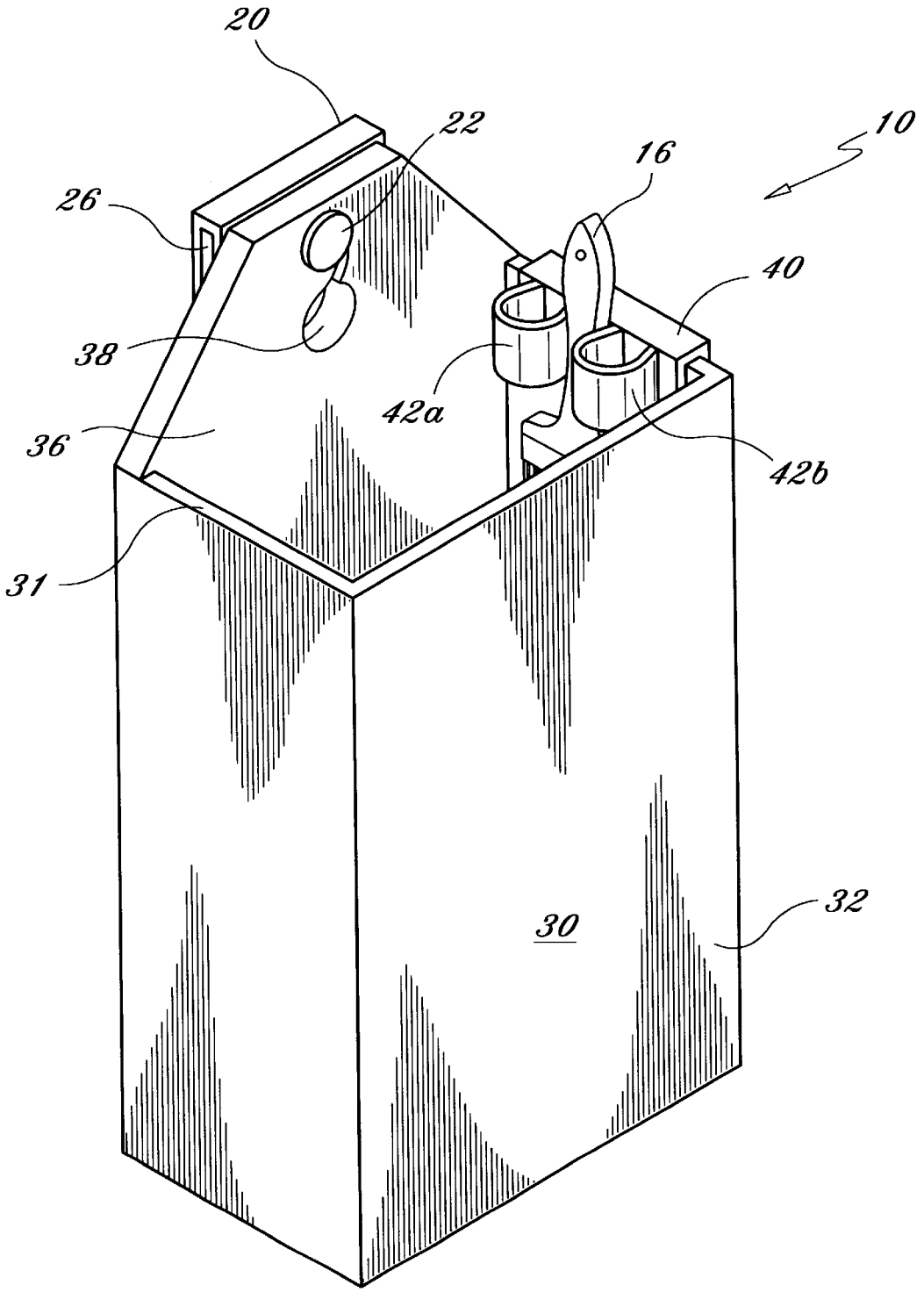
FIG. 2 is an upper perspective view of the present invention with the paintbrush attached.
Figure 3:
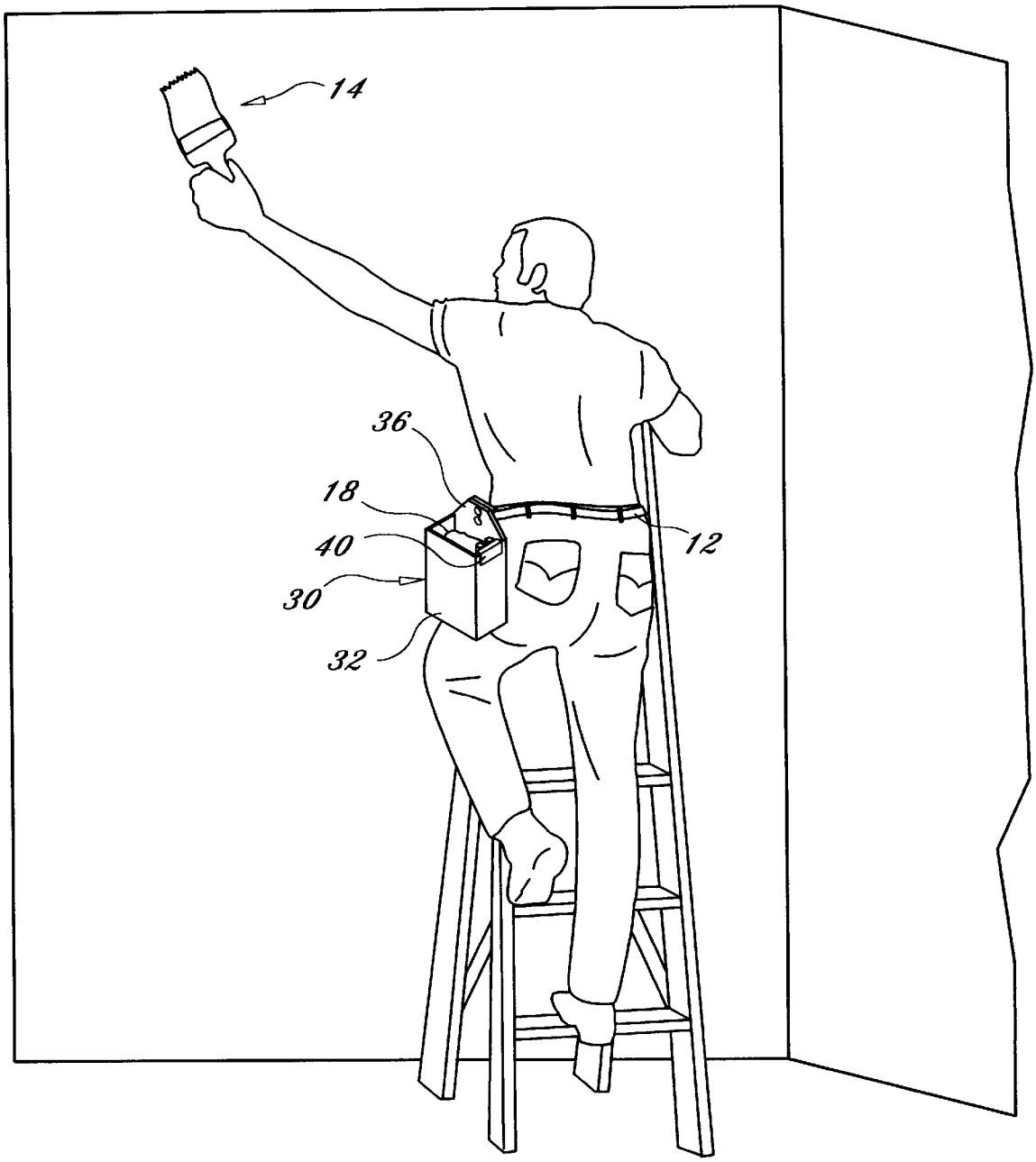
FIG. 3 is an upper perspective view of the present invention attached to a person.
Figure 5:
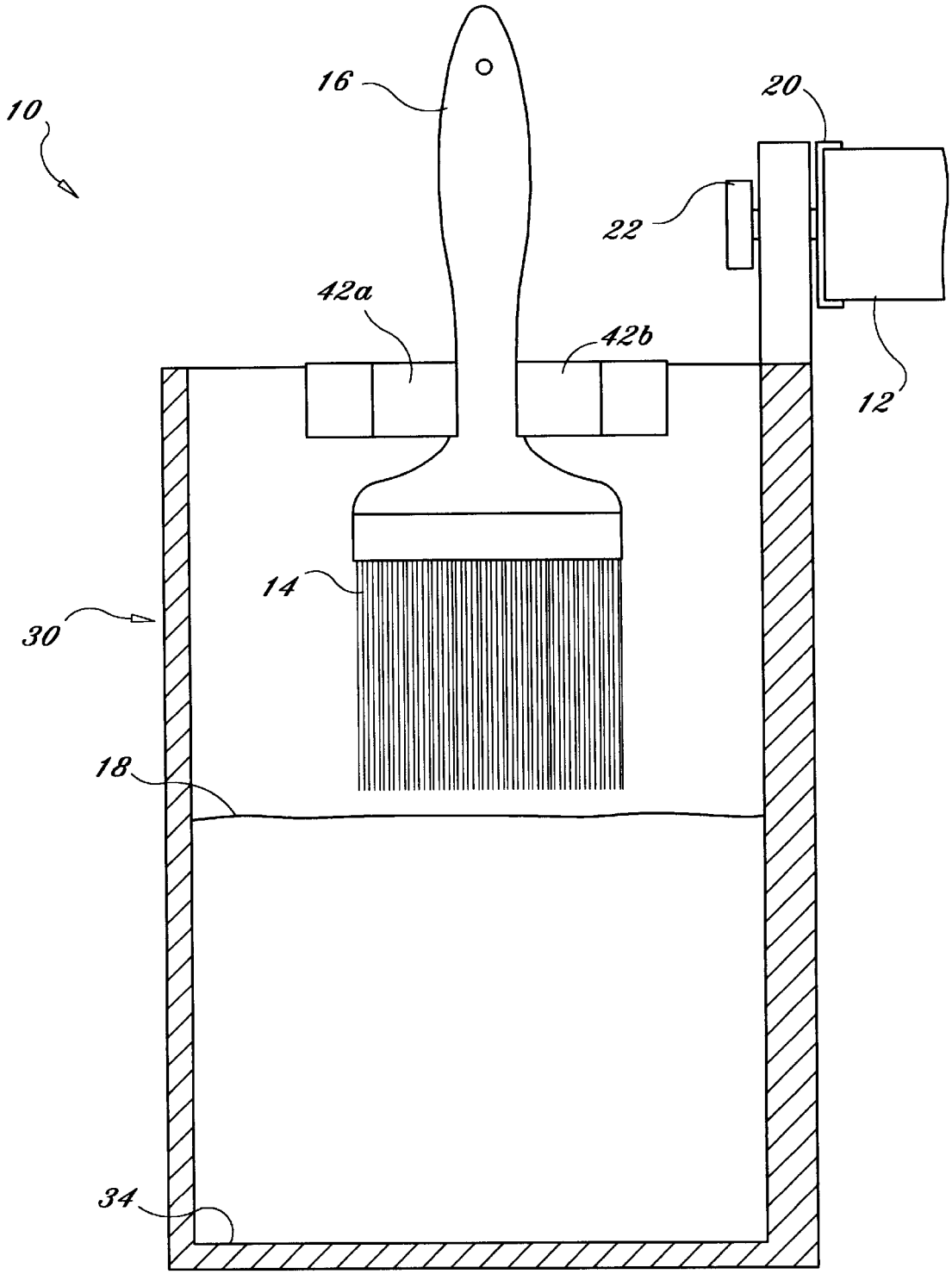
FIG. 5 is a side cutaway view of the present invention.

As shown in FIGS. 4 and 5, the container 30 includes a floor 34 attached to the lower portions of the side walls 32. As shown in FIGS. 1, 2 and 4 of the drawings, the container 30 includes an open end 31 for receiving the paint and the paintbrush 14. The open end 31 may have any well-known shape such as circular or rectangular.

As best shown in FIGS. 1 and 2 of the drawings, one of the side walls 32 has an extended portion 36 that tapers upwardly. It can be appreciated that the extended portion 36 can have any well-known shape. The upper portion of the extended portion 36 includes a receiver aperture 38 for pivotally receiving the shaft 24 of the belt adapter 20. The receiver aperture 38 preferably has a broader lower portion for receiving the flanged end 22 and a narrower upper portion for pivotally receiving the shaft 24 without allowing the flanged end 22 to project through. As best shown in FIGS. 1 and 2 of the drawings, the narrower upper portion of the receiver aperture 38 may have a curved shape for maintaining the shaft 24 within the receiver aperture 38.

As best shown in FIG. 1 of the drawings, a bracket 40 for capturing a paintbrush 14 is provided and is attachable to one of the side walls 32 of the container 30 adjacent the open end 31. The bracket 40 has a C-shaped cross sectional area for snugly attaching to the rim of the container 30 as best shown in FIG. 1 of the drawings.

As best shown in FIGS. 2, 4 and 5, the bracket 40 includes a pair of opposing clips 42*a–b*. The clips 42*a–b* are preferably resilient for allowing expansion and contraction for retaining a handle 16 of the paintbrush 14 between thereof. The clips 42*a–b* may me constructed of any well-known structure for frictionally retaining the handle 16 of the handle 16 in between.

In use, the user attaches their hip belt 12 upon their pants while simultaneously positioning the belt adapter 20 onto the hip belt 12 as shown in FIG. 4 of the drawings. If the user is left handed, they generally will position the belt adapter 20 on their left side. If the user is right handed, they generally will position the belt adapter 20 on their right side. The user then fills the container 30 with paint or other fluid. The user then positions the bracket 40 in the desired location upon the container 30 for retaining the paintbrush 14 preferably above the paint level. The user then positions the handle 16 of the paintbrush 14 into the bracket 40 for storage during non-use. The user then positions the flanged end 22 of the shaft 24 through the broader lower portion of the receiver aperture 38 and then lowers the container 30 onto the shaft 24. The container 30 may now swivel to compensate for the movements of the user thereby maintaining a constant vertical position thereby preventing spillage of the paint within the container 30. The user's hands are now free to climb ladders and other structures without having to carry the container 30 or a conventional paint can. The user grasps the handle 16 of the paintbrush 14 thereby removing the paintbrush 14 from the bracket 40. The user then lowers the bristles of the paintbrush 14 into the paint 18 and utilizes the paintbrush 14 as they normally would. When finished painting, the user inserts the paintbrush 14 back into the bracket 40 thereby allowing the user to climb down the ladder or other structure. The user then lifts the container 30 upwardly thereby positioning the flanged end 22 of the shaft 24 within the broader lower portion of the receiver aperture 38 thereby allowing the container 30 to be removed and cleaned.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

ENVIRONMENTAL ELEMENTS

10. Paint Container System
11.
12. Hip Belt
13.
14. Paintbrush
15.
16. Handle 16
17.
18. Paint Level
19.
20 Belt Adapter
21.
22. Flanged End
23.
24. Shaft
25.
26. Lumen 26
27.
28.
29.
Container
31. Open End
32. Side Walls
33.
34. Floor
35.
36. Extended Portion
37.
38. Receiver Aperture
39.
40. Bracket
41.
42. Clips (a–b)
43.
44.
45.
46.
47.
48.
49.
50.
51.
52.
53.
54.
55.
56.
57.
58.
59.
60.
61.
62.
63.
64.
65.
66.
67.
68.
69.
70.
71.
72.
73.
74.
75.
76.
77.
78.
79.

I claim:

1. A paint container system, comprising:

a container having at least one wall, a floor, and an open end, wherein said container is capable of storing a volume of fluid; and an adapter having a tubular shape that is positionable upon a belt of said person;

a shaft member having a flanged end extending from said adapter removably received by a receiver aperture within said at least one wall for pivotally supporting said container; and wherein said receiver aperture comprises a lower broad portion sufficient to receive said flanged end of said shaft member and an upper narrow portion connected to said lower portion, wherein said upper portion is narrow enough to prevent said flanged end from passing through; and wherein said upper narrow portion is curved for preventing said shaft member from accidentally becoming removed from said lower broad portion of said receiver aperture.

2. The paint container system of claim 1, including a means for securing a paintbrush within said container.

3. The paint container system of claim 2, wherein said means for securing a paintbrush comprises:

a cuff member removably attachable about said open end of said container; and a pair of resilient arms extending from said cuff member for frictionally engaging a handle of said paintbrush.

4. The paint container system of claim 1, wherein said upper narrow portion is C-shaped.

5. The paint container system of claim 4, wherein said upper narrow portion has an upper end that is substantially parallel to a ground surface.

6. The paint container system of claim 1, wherein said container includes an extended portion extending from said at least one wall, wherein an upper portion of said extended portion includes said receiver aperture.

7. The paint container system of claim 6, wherein said extended portion tapers upwardly.

8. The paint container system of claim 1, wherein said container is constructed of plastic.

9. The paint container system of claim 1, wherein said at least one wall is comprised of four walls.

* * * * *